US009869532B2

(12) United States Patent
Kent

(10) Patent No.: US 9,869,532 B2
(45) Date of Patent: Jan. 16, 2018

(54) MARITIME BALLISTIC SAFETY CARRIER

(71) Applicant: David G. Kent, Morehead City, NC (US)

(72) Inventor: David G. Kent, Morehead City, NC (US)

( * ) Notice: Subject to any disclaimer, the term of this patent is extended or adjusted under 35 U.S.C. 154(b) by 79 days.

(21) Appl. No.: 15/153,265

(22) Filed: May 12, 2016

(65) Prior Publication Data

US 2016/0370150 A1 Dec. 22, 2016

Related U.S. Application Data

(62) Division of application No. 13/770,375, filed on Feb. 19, 2013, now Pat. No. 9,366,505.

(60) Provisional application No. 61/599,711, filed on Feb. 16, 2012.

(51) Int. Cl.

| | |
|---|---|
| ***B63C 9/08*** | (2006.01) |
| ***F41H 1/02*** | (2006.01) |
| ***B63C 9/15*** | (2006.01) |
| ***B63C 9/115*** | (2006.01) |
| ***B63C 9/125*** | (2006.01) |
| ***A41D 13/012*** | (2006.01) |
| ***A41D 1/04*** | (2006.01) |

(52) U.S. Cl.

CPC ..... *F41H 1/02* (2013.01); *A41D 1/04* (2013.01); *A41D 13/0125* (2013.01); *B63C 9/081* (2013.01); *B63C 9/1255* (2013.01); *B63C 9/155* (2013.01); *B63C 9/115* (2013.01)

(58) Field of Classification Search

CPC ..... B63C 9/081; B63C 9/11; B63C 9/115; B63C 9/125; B63C 9/1255; B63C 9/155; A41D 1/04; A41D 13/0125; F41H 1/00; F41H 1/02

USPC ..... 441/88, 92–97, 106–119; 2/2.5; 89/36.01, 36.05

See application file for complete search history.

(56) References Cited

U.S. PATENT DOCUMENTS

| | | | |
|---|---|---|---|
| 4,024,440 | A | 5/1977 | Miller |
| 4,864,656 | A | 9/1989 | Nesse |
| 5,385,496 | A | 1/1995 | Seligman |
| 5,456,623 | A | 10/1995 | Norris |
| 5,584,737 | A | 12/1996 | Luhtala |
| 5,996,115 | A | 12/1999 | Mazelsky |
| 6,070,274 | A | 6/2000 | van der Sleesen |
| 6,203,246 | B1 | 3/2001 | Courtney |

(Continued)

OTHER PUBLICATIONS

U.S. Appl. No. 15/367,561, filed Dec. 2, 2016.

*Primary Examiner* — Ajay Vasudeva
(74) *Attorney, Agent, or Firm* — McLane Middleton, Professional Association

(57) ABSTRACT

A floatation member for ballistic carrier vest includes a first outer layer and an intermediate layer overlying the first outer layer. A peripheral edge of the intermediate layer is secured to a peripheral edge of the first outer layer to define a first cavity therebetween. A panel selected from a non-ballistic panel and a ballistic panel is received within the first cavity. A second outer layer overlies the intermediate layer and a peripheral edge of the second outer layer secured to the peripheral edge of the intermediate layer to define a second cavity therebetween. A valve configured to deliver an inflation gas into the second cavity. In a further aspect, a ballistic safety article for providing ballistic protection for a person is provided.

19 Claims, 17 Drawing Sheets

(56) References Cited

U.S. PATENT DOCUMENTS

| | | | | |
|---|---|---|---|---|
| 6,389,594 | B1 | 5/2002 | Yavin | |
| 6,408,733 | B1 | 6/2002 | Perciballi | |
| 6,478,510 | B1 | 11/2002 | Young | |
| 6,681,399 | B1 | 1/2004 | Kerr | |
| 6,805,519 | B1 | 10/2004 | Courtney | |
| 6,997,218 | B1 | 2/2006 | Garcia et al. | |
| 7,004,808 | B1 * | 2/2006 | Nelson | B63C 9/1255 441/106 |
| 7,080,411 | B2 | 7/2006 | Kerr | |
| 7,210,390 | B1 | 5/2007 | Olson et al. | |
| 7,261,608 | B2 | 8/2007 | Haddacks | |
| 7,335,078 | B2 | 2/2008 | Kent | |
| 7,917,967 | B2 | 4/2011 | Osborne | |
| 8,808,048 | B2 | 8/2014 | Kent | |
| 9,248,893 | B2 * | 2/2016 | Hellweg | F41H 1/02 |
| 9,340,266 | B2 | 5/2016 | Kent | |
| 9,366,505 | B2 | 6/2016 | Kent | |
| 2004/0157514 | A1 | 8/2004 | Courtney | |
| 2012/0289106 | A1 | 11/2012 | Kent | |
| 2013/0212764 | A1 | 8/2013 | Kent | |
| 2016/0347431 | A1 | 12/2016 | Kent | |

* cited by examiner

MARITIME BALLISTIC SAFETY CARRIER

CROSS-REFERENCE TO RELATED APPLICATIONS

This application is a divisional application of U.S. application Ser. No. 13/770,375 filed Feb. 13, 2013, which in turn claims priority based on U.S. Provisional Application No. 61/599,711 filed Feb. 16, 2012. The subject matter of this application is related to U.S. Provisional Application No. 61/484,394 filed May 10, 2011, and U.S. Patent Application Publication 2012/0289106 published Nov. 15, 2012. Each of the aforementioned applications and published application are incorporated herein by reference in its entirety.

SUMMARY

The present development provides for the integration of flotation into a ballistic carrier and is therefore particularly advantageous for maritime use. The inflatable panels herein are adapted for use with a ballistic carrier, such as an armor vest having a front portion, back portion, left and right shoulder portions and left and right cummerbund portions. The cummerbund portion may include fasteners securing the carrier, and may be of any known type, including without limitation, grommet pin loop type fasteners, zippers, hook and loop fasteners, snap fasteners, straps, buckles, or other fastening hardware.

In certain embodiments, a panel insert comprising an inflatable bladder is provided which may be inserted behind a ballistic panel in a ballistic panel-carrying garment. In other embodiments, the inflatable panel insert herein may have integrated ballistics and may be inserted into the ballistics carrier in place of or in addition to a hard or soft ballistic panel or plate.

In certain embodiments, the bladder includes one or more foam layers received within the bladder which provides the wearer with neutral buoyancy when the bladder is not inflated. In this manner, a user may enter the water with neutral buoyancy and may inflate the bladder in the event additional lift is needed. Inflation of the bladder provides additional buoyancy, e.g., in the event of an emergency. The foam layer may be a closed cell foam material or more preferably a hard cell or impact resistant foam. The foam layer may be laminated within the bladder cavity to one or both of the of the bladder panels, e.g., via radio frequency (RF) welding, thermal bonding, adhesive, or the like. In certain embodiments, the bladder insert may also have one or more hard armor plates, one or more soft armor layers, or a combination thereof, integrated within the bladder. The hard and/or soft armor layer may be in place of or in addition to the foam layer. In embodiments including hard and/or soft armor, the foam layer(s) may be laminated directly to the armor layer(s).

The bladder includes a valve for introducing air or other inflation gas into the interior compartment defined by the bladder for providing additional buoyancy. In certain embodiments, the valve may be an oral inflation valve, e.g., of the type having a check valve, for oral inflation of the bladder. In certain embodiments, the oral inflation valve may include an optional pressure relief valve which prevents overinflating the bladder.

In alternative embodiments, the valve may include an insert, such as a threaded insert for receiving a $CO_2$ cartridge. For typical applications, the $CO_2$ canister may range from about 8 to about 12 grams, although other sizes and configurations are contemplated. A manual inflation handle may be mechanically linked to the valve, e.g., to actuate a lever on the valve which operates a piercing pin to allow the pressurized $CO_2$ to enter the bladder. In still further embodiments, an auto-inflation valve may be provided. Such valve may include an electronic actuator which electrically senses the water.

Alternatively, the auto actuator may be of the type which uses a compressed member such as a spring which is actuated in the presence of water (e.g., by using a soluble bobbin or pill) which drives a piercing member to pierce the cartridge and to allow the pressurized gas to enter the bladder chamber. In an especially preferred embodiment, a water resistant cover may be provided over the soluble bobbin so as to slow or delay the entry of water. In this manner, environmental moisture such as rain, sea spray, humidity, or the like will not cause inadvertent inflation of the bladder, but which will admit water to actuate the auto inflation in the event of submersion in water. The auto-actuator may be of the type commercially available from Halkey-Roberts and others.

Where multiple bladders are provided, e.g., such as front and rear bladder panels, each panel may be separately inflatable. Alternatively a conduit (for example, a tube which may pass from the front to the rear, e.g., routed in or along the shoulder portion) may be provided to fluidicly couple multiple bladders, such that one inflation valve can be provided to inflate the multiple bladders.

In the depicted preferred embodiments, the inflatable panels include one or more breakable connections or seams which are configured to allow the panel to hold a certain volume of gas when the panel is inflated up to a certain threshold pressure. When the threshold pressure is exceeded, the breakable connections separate and allow the panel to expand to hold a larger volume of gas, thereby increasing buoyancy and lift. For example, an oral inflation tube may include an over pressure valve which prevents the user from exceeding the threshold pressure when the bladder is in normal everyday use. In the event that the $CO_2$ canister fires, the over pressure valve will release pressure prior to blowing the outer, peripheral seam of the bladder, but will potentially allow the breakable pleats of the bladder to blow out to allow the bladder to be over inflated for maximum lift capabilities. In certain embodiments, the pressure required to separate the breakable pleats may be selected to allow the user to selectively over inflate the bladder by selection of a specific size of $CO_2$ cartridge. For example, the user may selectively attach a $CO_2$ cartridge having a lesser quantity of $CO_2$ sufficient to inflate the cartridge without breaking the pleats or one with a greater quantity of $CO_2$ sufficient to blow out the separable pleats and over inflate the bladder for additional lift capability. In preferred embodiments, the pleats may be configured not to blow out when, for example, an 8 gram $CO_2$ canister is employed, and to blow out when a larger $CO_2$ canister is employed, such as an 11 gram or larger $CO_2$ canister. It will be recognized, however, that other configurations adapted for other sizes of gas canisters are also contemplated.

The panels depicted herein are for use in the front and rear compartments of the carrier. It will be recognized, however, that the inflatable bladders may also be adapted for use in the cummerbund, e.g., to provide side armor protection.

DETAILED DESCRIPTION OF THE PREFERRED EMBODIMENTS

Figure 1:
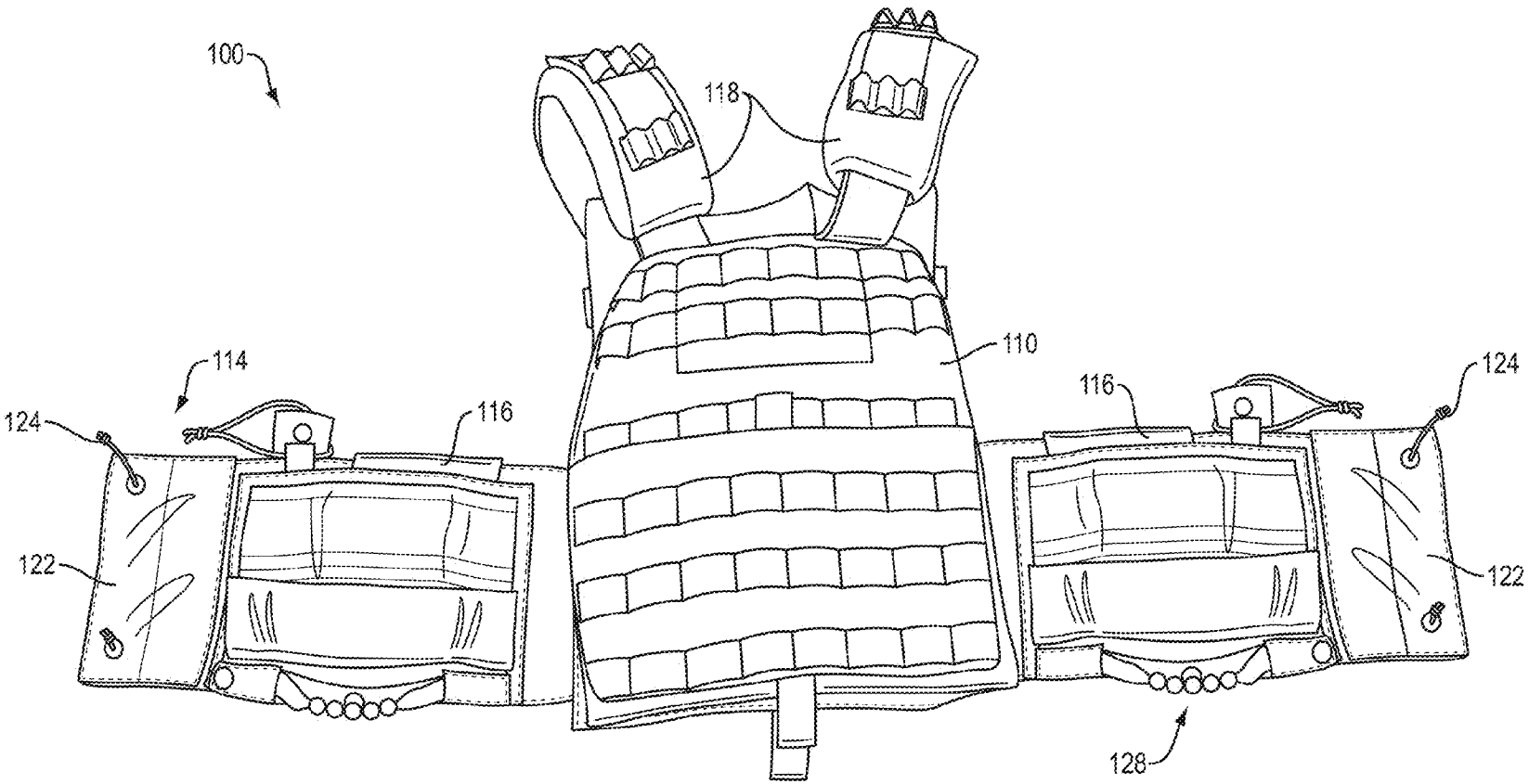
FIG. 1 is a front view of an exemplary ballistic carrier vest operable to embody the present invention.
Figure 2:
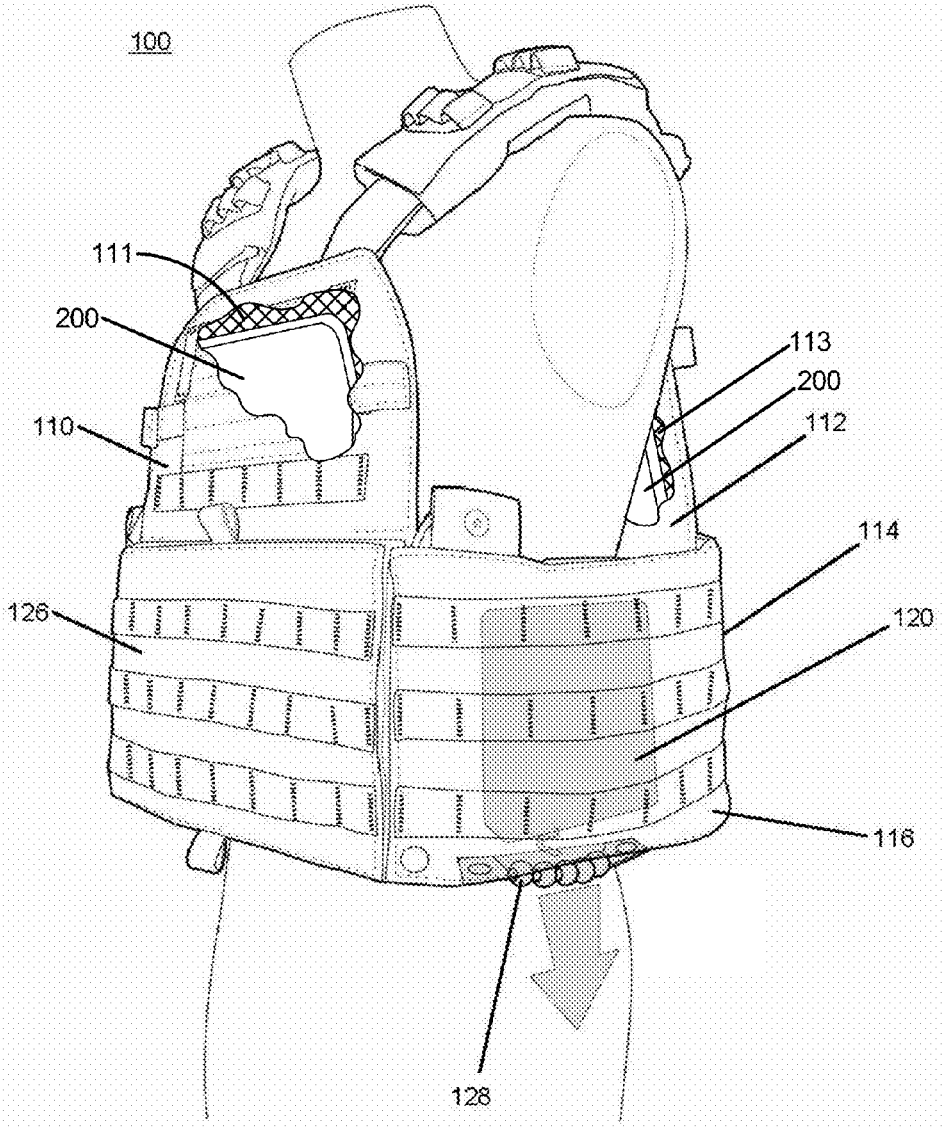
FIG. 2 is a perspective view of an exemplary ballistic carrier herein in an operable position about the torso of a user.
Figure 3:
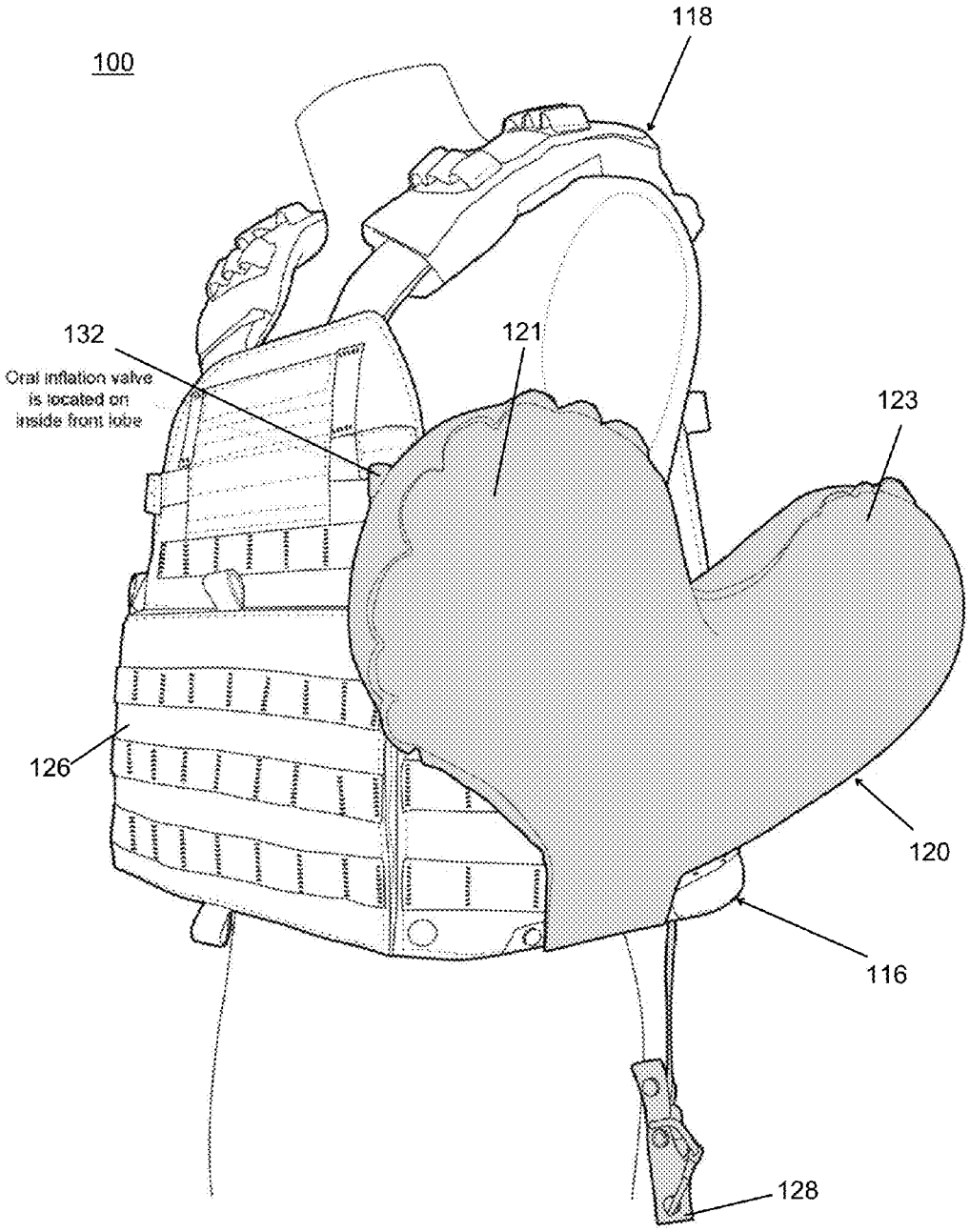
FIG. 3 is a perspective view of the exemplary ballistic carrier herein appearing in FIG. 2, with the optional side floatation bladders deployed.
Figure 4:
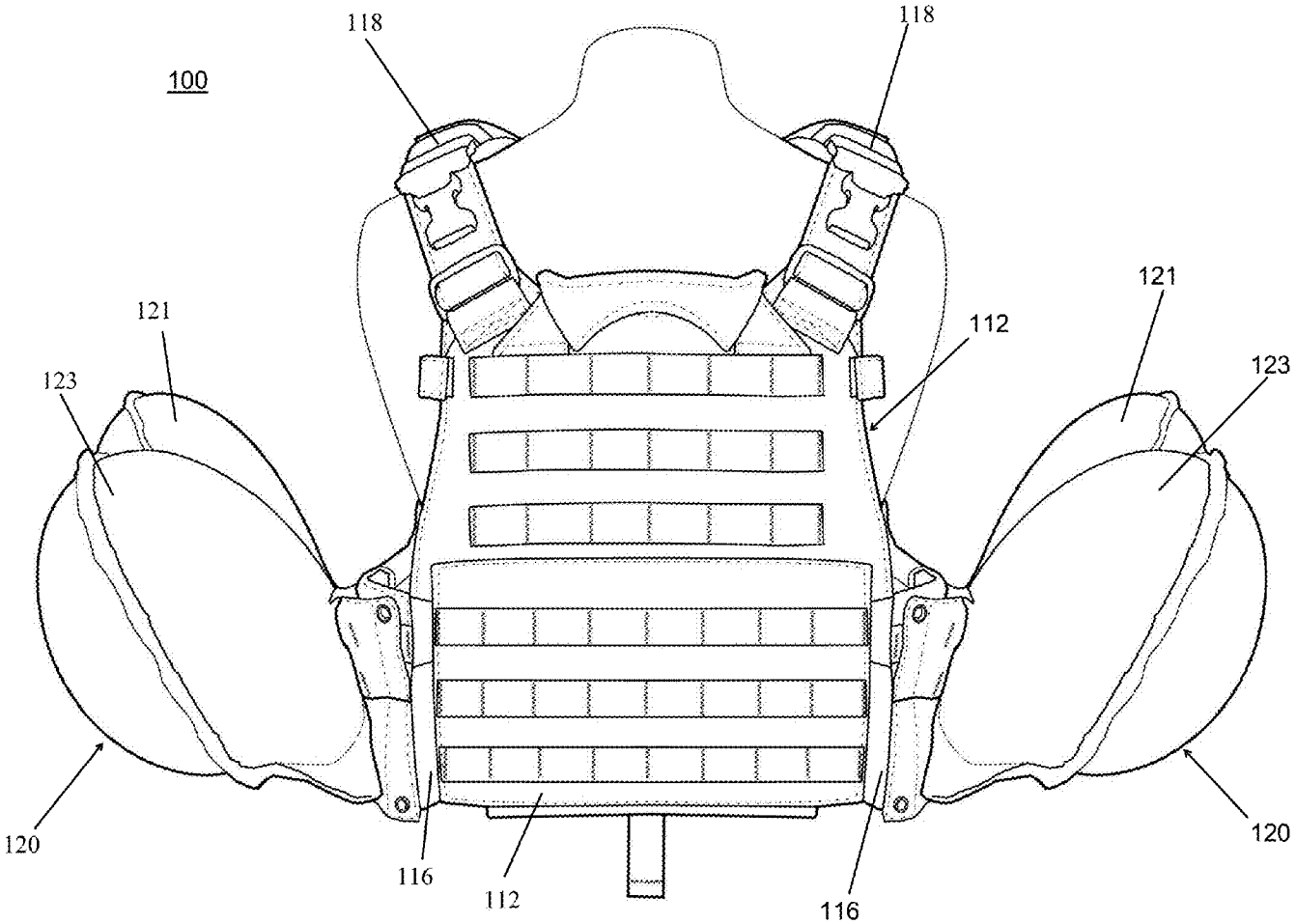
FIG. 4 is a rear view of the exemplary carrier herein with the optional side floatation bladders deployed.

Referring now to the drawings, FIGS. 1-4 show an exemplary embodiment ballistic plate or insert carrier 100, which includes a front panel section 110, a rear panel 112 opposite and facing the front panel 110, and a cummerbund 114 defining left and right side panels 116. The plate carrier 100 may be sewn and constructed generally of nylon fabrics or other natural or synthetic fabric. The carrier 100 includes one or more internal compartments or pockets for receiving one or more ballistic inserts which may be rigid ballistic plates, soft body armor inserts, and so forth, including a front carrier pocket 111 in the front panel 110 and a rear carrier pocket 113 in the rear panel 112. The ballistics vest herein may also include various fasteners, including hook and loop fasteners, snaps, buckles, buttons, ties, and so forth, for securing or connecting various flaps, components, compartments and closures of the carrier 100, as well as for affixing external equipment to the plate carrier. The carrier 100 may include webbing or straps for affixing pouches or other equipment as is known in the art.

A pair of padded shoulder straps 118 extend between the front and rear panels. Optionally, each strap 118 may include a buckle, such as a quick connect/disconnect buckle or other fastener thereon for providing a detachable connection between the front and rear panel.

The cummerbund 114 wraps around wearer and secures the rear panel 112 to the front panel 110. The side panels 116 of the cummerbund 114 each include an internal compartment receiving an inflatable bladder 120. The inflatable bladders 120 may be as described in the above-incorporated Publication No. 2012/0289106. The cummerbund 114 may pass through a sleeve (not shown) in rear panel section 112. The ends 122 of the cummerbund 114 may be secured to the front panel member 110 by ties 124. When secured, the ends 122 of the cummerbund 114 may be covered by a lower flap 126 on the outer surface of the front carrier portion 110.

The side panels 116 include activation handles 128 to actuate an inflation mechanism associated with each bladder 120. The actuation mechanism includes a source of pressurized gas, such as one or more $CO_2$ cartridges and a valve which pierces the $CO_2$ cartridge to allow the pressurized gas to flow into the bladder 120, and may be as described in the above-incorporated Publication No. 2012/0289106.

When the pull handle 128 is tugged, the inflation bladder 120 is released through an opening 130 in the side panel and inflates. If the inflation bladder 120 fails to inflate, the user may manually inflate the inflation bladder 120 using an oral inflation valve 132 located on the bladder 120. The bladder 120 may have a generally lobed shape wherein the user's arm may pass between front and rear lobes 121, 123. The oral inflation valve 132 is preferably located on the user-facing surface of the front lobe 121 so as to be positioned near the user's mouth. Actuation mechanism may also include a switch, such as an electric or other automatic actuation means for automatically inflating the bladders when the user is submersed as described in the above-incorporated Publication No. 2012/0289106. Likewise, the auto inflate mechanism may also include a water resistant cover to slow or delay entry of water to prevent or reduce the chance of inadvertent inflation due to water spray or other environmental moisture as described in the above-incorporated Publication No. 2012/0289106. Although the invention is depicted in reference to a particular ballistic carrier, it will be recognized that the inflatable bladders herein may be used with all manner of other ballistic carriers.

In addition to or as an alternative to the flotation bladders 120 received within the side panels 116, one or more flotation members 200 may be received within the ballistic panel pockets in the front panel 110, rear panel 112, or both.

The floatation members may be adapted for removable or detachable insertion into the ballistic panel/plate carrier pockets in the vest 100, and may include an integral foam panel, a rigid body armor plate, a soft body armor plate, or any combination thereof. In certain embodiments, the flotation member may include a foam panel (e.g., a closed cell foam panel, impact resistance foam panel, etc.) which is received within the pocket together with a separate hard or soft ballistic insert. In such embodiments, the floatation member should advantageously be positioned behind (relative to a fired projectile) the ballistic insert to reduce back face deformation of the ballistic insert or otherwise reduce the impact force of a non-penetrating projectile. Similarly, in embodiments wherein a hard or soft ballistic layer is integrated into the floatation member, the inflatable bladder portion should be positioned toward the user's body, opposite the strike face of the ballistic layer to reduce back face deformation of the ballistic floatation member or otherwise reduce the impact force of a non-penetrating projectile.

Figure 5A:
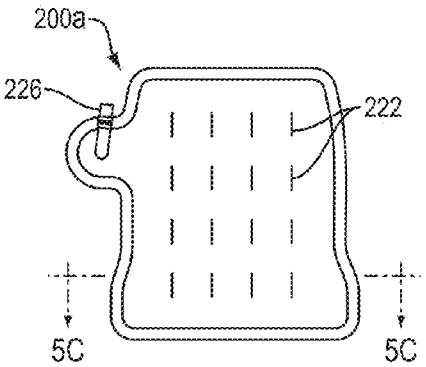
FIG. 5A is a plan view of an exemplary right-sided bladder which is adapted for use in a size large or extra-large MBAV cut carrier vest.
Figure 5B:
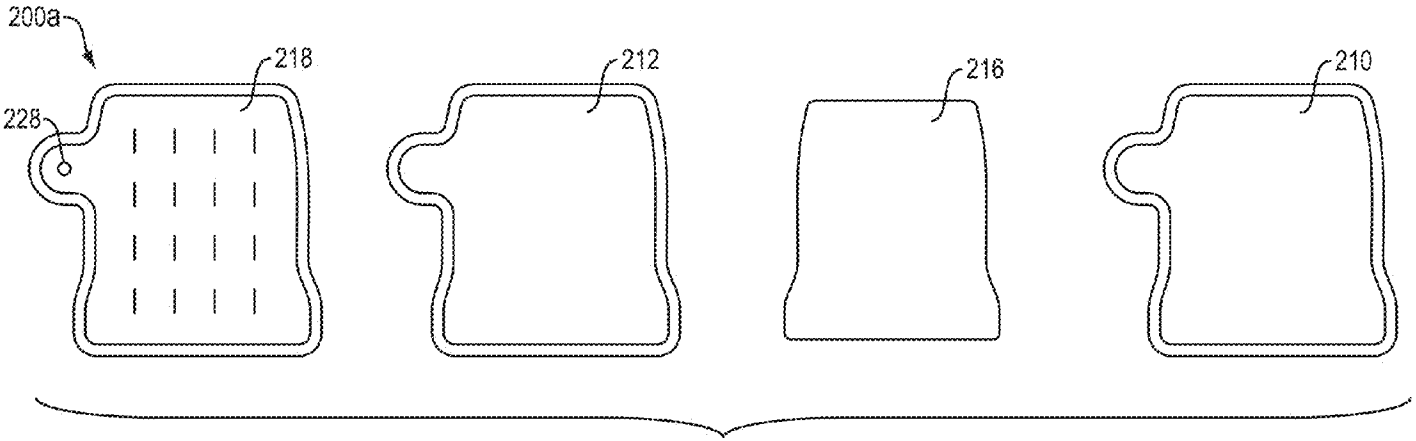
FIG. 5B is an exploded view of the embodiment appearing in FIG. 5A, illustrating the laminated construction.
Figure 5C:
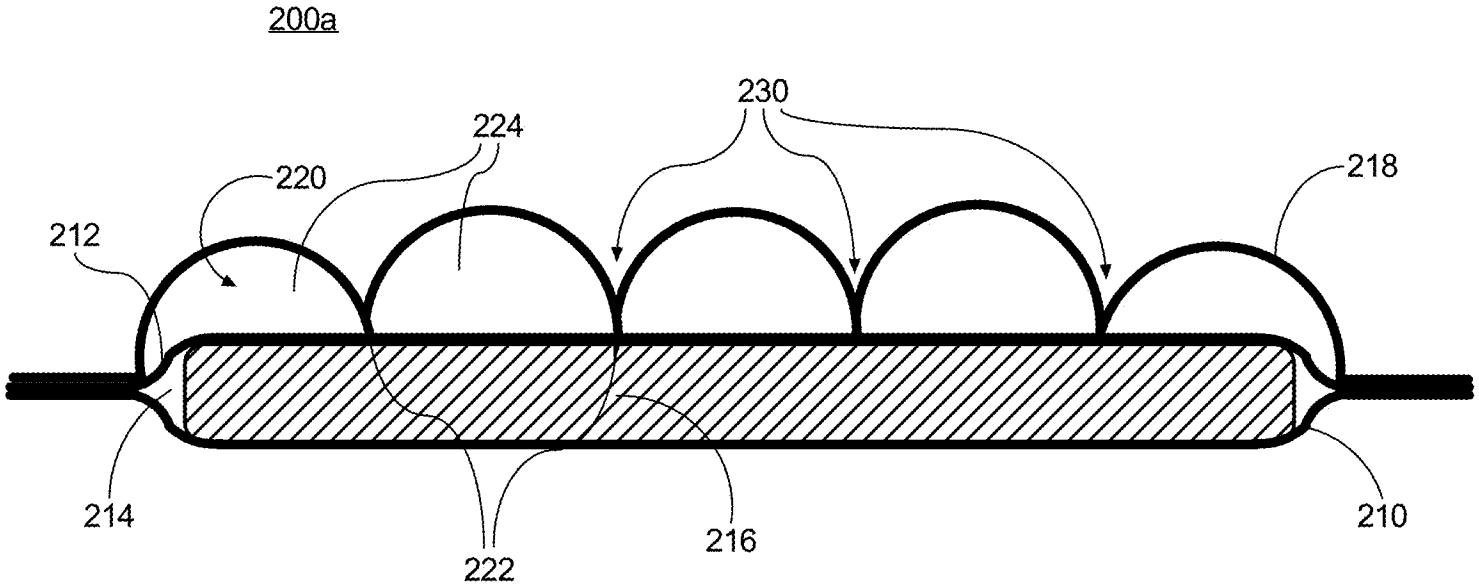
FIG. 5C is a cross-sectional view taken along the lines 5C-5C appearing in FIG. 5A.

A first exemplary inflatable floatation member 200*a* appears in FIGS. 5A-5C. The floatation member 200*a* illustrated is adapted for use with a size large or extra-large MBAV carrier vest, although it will be recognized that the floatation member could be adapted for use with all manner of carrier vest standards or configurations. The insert 200*a* includes a front panel 210 defining a first outer layer or shell of the insert 200*a* and an intermediate panel 212. The front panel 210 and the intermediate panel 212 define a first compartment 214 receiving a plate member 216. A bladder panel 218 is disposed over the intermediate layer 212 and secured to the layer about the periphery to define an inflatable chamber 220. The front, intermediate, and bladder panels 210, 212, and 218, respectively, may be formed of a polymer sheet material, air- and water-tight fabric material, plastic coated fabric, such as nylon, and so forth.

The front, intermediate, and bladder panels 210, 212, and 218, are sealed about the peripheral edges, preferably via RF welding, although other method for bonding, welding, or sealing the plastic layers are also contemplated. The front and intermediate panels 210, 212 are preferably bonded, e.g., RF welded, to the opposite surfaces of the plate member 216. The plate member 216 preferably has a polymer outer layer of skin 217 to further prevent the entry of water into the foam or ballistic material forming the plate member.

The plate 216 may be a foam member to provide some initial degree of buoyancy compensation when the bladder chamber 220 is uninflated, e.g., to allow the user to achieve neutral buoyancy when the user is submersed, and a greater degree of buoyancy compensation, e.g., positive buoyancy, when the bladder is inflated. Alternatively, the plate member could be a ballistic plate, including a rigid armor plate or a soft ballistic panel. In still further embodiments, the plate member could comprise multiple elements including any combination of foam, hard ballistic plate, and soft ballistic plate.

The bladder panel layer 218 is pleated to provide an interior volume for air or other inflation gas. The bladder panel is preferably attached, e.g., via RF welding, to the intermediate panel 212 at a plurality of locations 222 to provide shape or structure to the inflated bladder. In the illustrated embodiment, the attachment locations 222 are generally oriented along generally vertical parallel lines or seams to define a plurality of inflation chambers 224 which serve to allow the bladder to conform to the user's body. The pleated configuration also defines a plurality of channels 230 extending along the bladder thereby providing channels allowing air flow between the bladder surface and the user to increase the comfort of the user.

The attachment seams 222 are segmented to provide a fluidic interconnection between the multiple adjacent chambers 224. An oral inflation valve 226, such as a one-way check valve, is provided at an opening 228 in the bladder panel 218. An auto-inflation mechanism and or pressure release valve may also be provided as described herein. In an especially preferred embodiment, the attachment points 222 are configured to rupture at a pressure which is less than the pressure required to rupture the bladder material 218 of the weld of bond formed at the peripheral edge of the bladder panel 218.

Figure 6A:
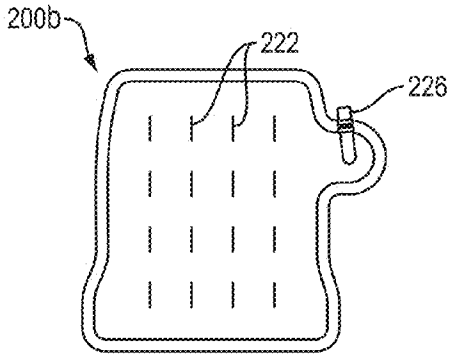
FIG. 6A is a plan view of an exemplary left-sided bladder which is adapted for use in a size large or extra-large MBAV cut carrier vest.
Figure 6B:
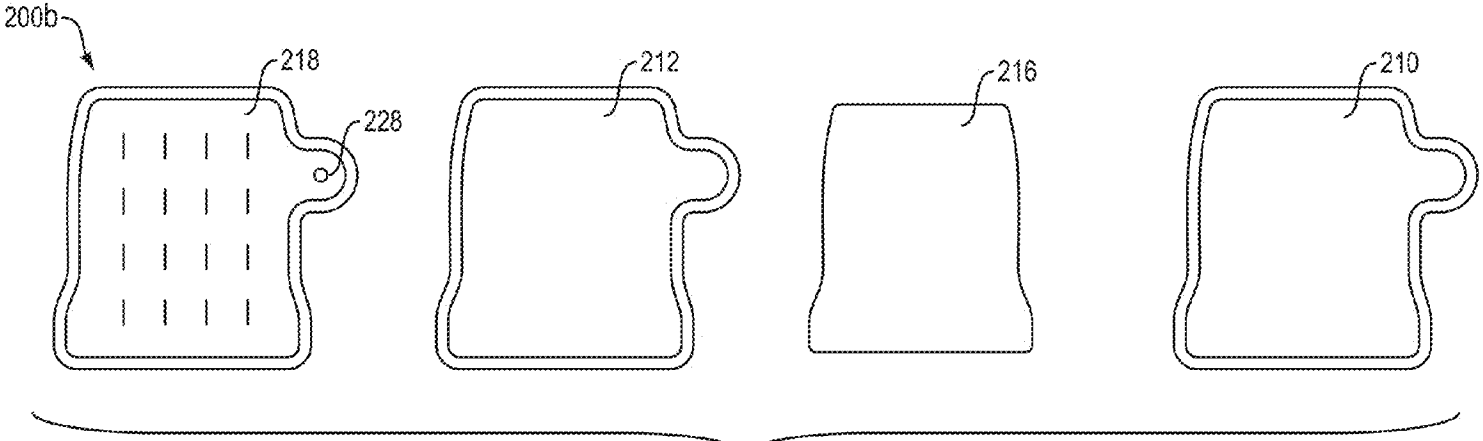
FIG. 6B is an exploded view of the embodiment appearing in FIG. 6A.

Referring now to FIGS. 6A and 6B, there is shown a floatation member 200*b*, which is a mirror image of the floatation member 200*a* appearing in FIGS. 5A-5C, such that the opening 228 and inflation tube 226 are on the opposite side of the unit. The floatation member 200*b* of FIGS. 6A and 6B is otherwise as described above by way of reference to FIGS. 5A-5C.

Figure 7A:
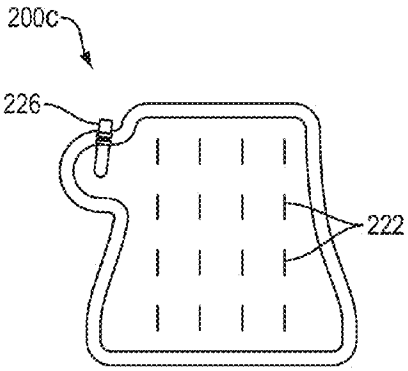
FIG. 7A is a plan view of an exemplary right-sided bladder which is adapted for use in a size small or medium MBAV cut carrier vest.
Figure 7B:
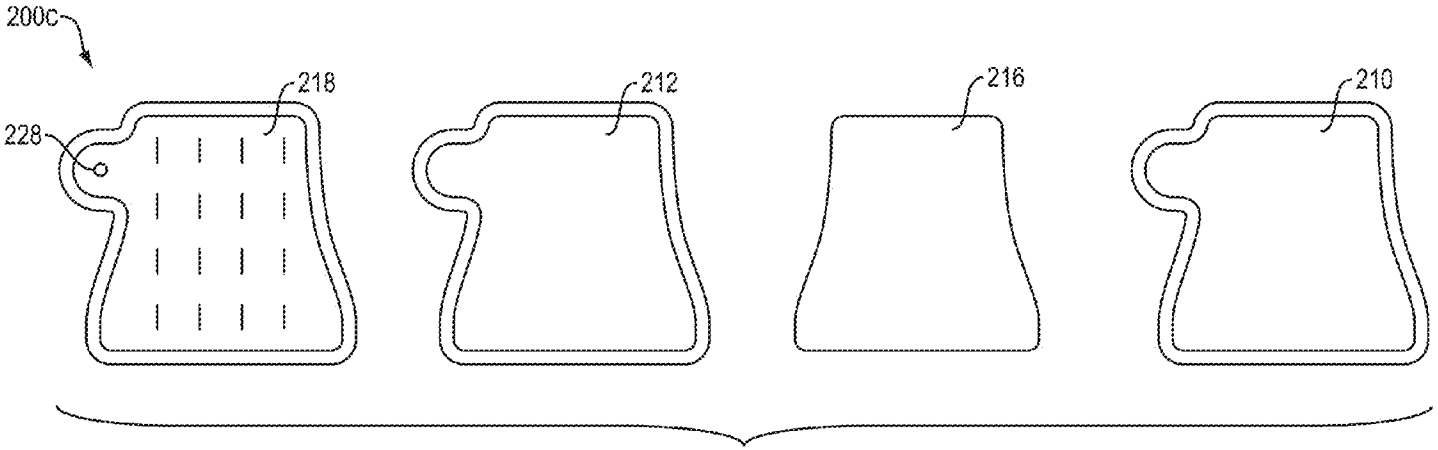
FIG. 7B is an exploded view of the embodiment appearing in FIG. 7A.

FIGS. 7A and 7B illustrate a further exemplary floatation member 200*c*, which is adapted for use with a size small or medium MBAV carrier vest. The floatation member 200*c* of FIGS. 7A and 7B is otherwise as described above by way of reference to FIGS. 5A-5C.

Figure 8A:
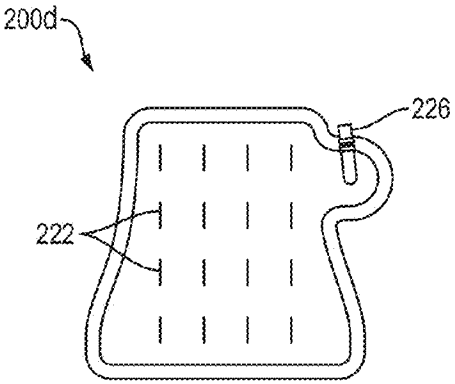
FIG. 8A is a plan view of an exemplary left-sided bladder which is adapted for use in a size small or medium MBAV cut carrier vest.
Figure 8B:
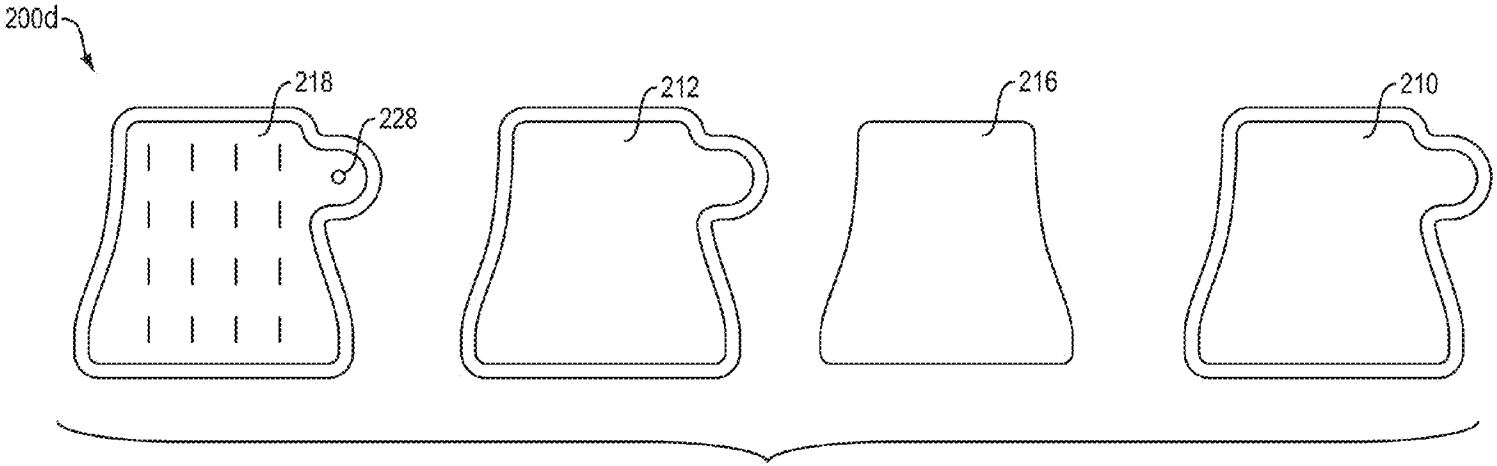
FIG. 8B is an exploded view of the embodiment appearing in FIG. 8A.

Referring now to FIGS. 8A and 8B, there is shown a floatation member 200*d*, which is a mirror image of the floatation member 200*c* appearing in FIGS. 7A and 7B, such that the opening 228 and inflation tube 226 are on the opposite side of the unit. The floatation member 200*d* of FIGS. 8A and 8B is otherwise as described for FIGS. 7A and 7B.

Figure 9A:
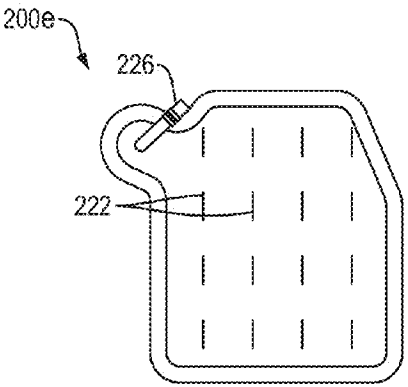
FIG. 9A is a plan view of an exemplary right-sided bladder which is adapted for use in a size large or extra-large swimmers cut carrier vest.
Figure 9B:
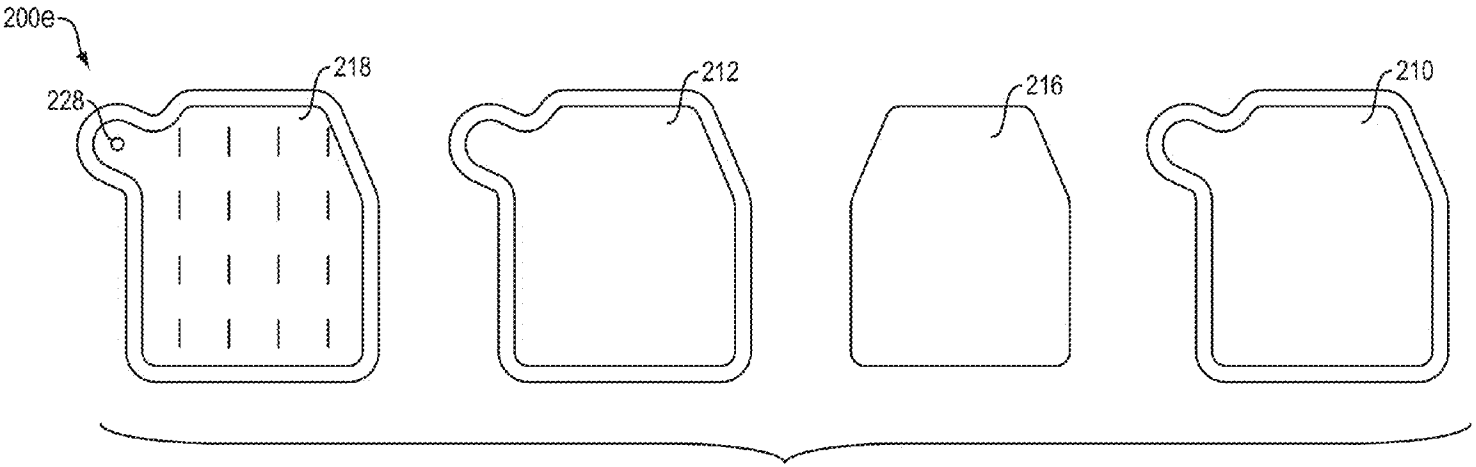
FIG. 9B is an exploded view of the embodiment appearing in FIG. 9A.

FIGS. 9A and 9B illustrate a further exemplary floatation member 200*e*, which is adapted for use with a size large or extra-large swimmers cut carrier vest. The floatation member 200*e* of FIGS. 9A and 9B is otherwise as described above by way of reference to FIGS. 5A-5C.

Figure 10A:
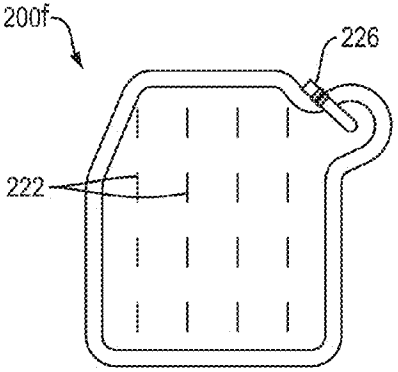
FIG. 10A is a plan view of an exemplary left-sided bladder which is adapted for use in a size large or extra-large swimmers cut carrier vest.
Figure 10B:
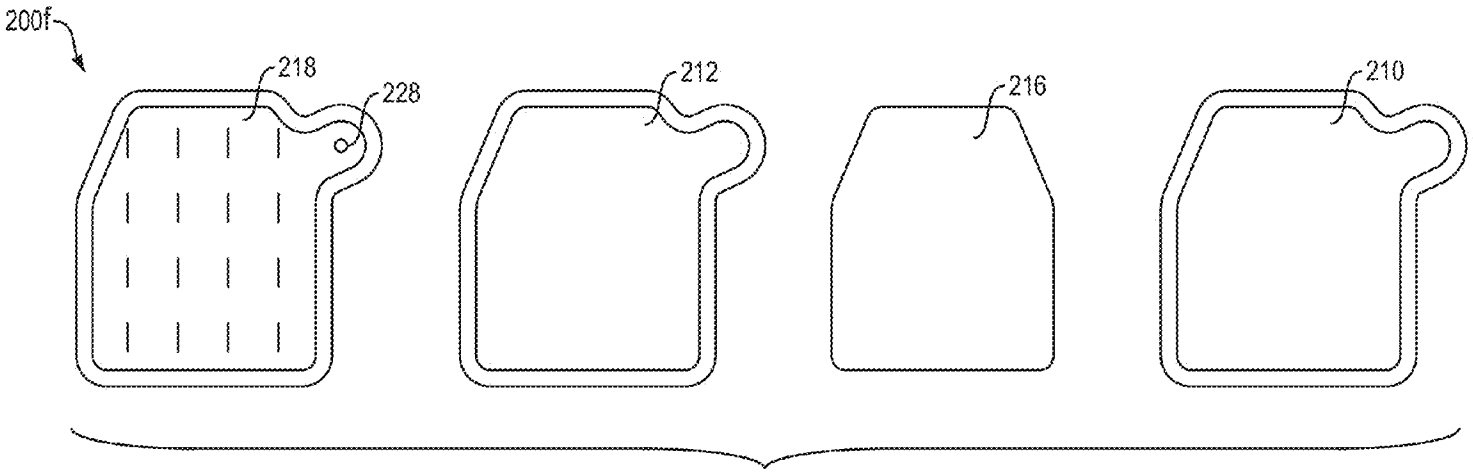
FIG. 10B is an exploded view of the embodiment appearing in FIG. 10A.

Referring now to FIGS. 10A and 10B, there is shown a floatation member 200*f*, which is a mirror image of the floatation member 200*e* appearing in FIGS. 9A and 9B, such that the opening 228 and inflation tube 226 are on the opposite side of the unit. The floatation member 200*f* of FIGS. 10A and 10B is otherwise as described for FIGS. 9A and 9B.

Figure 11A:
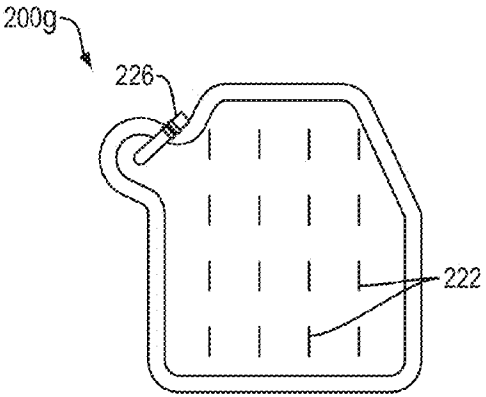
FIG. 11A is a plan view of an exemplary right-sided bladder which is adapted for use in a size small or medium swimmers cut carrier vest.
Figure 11B:
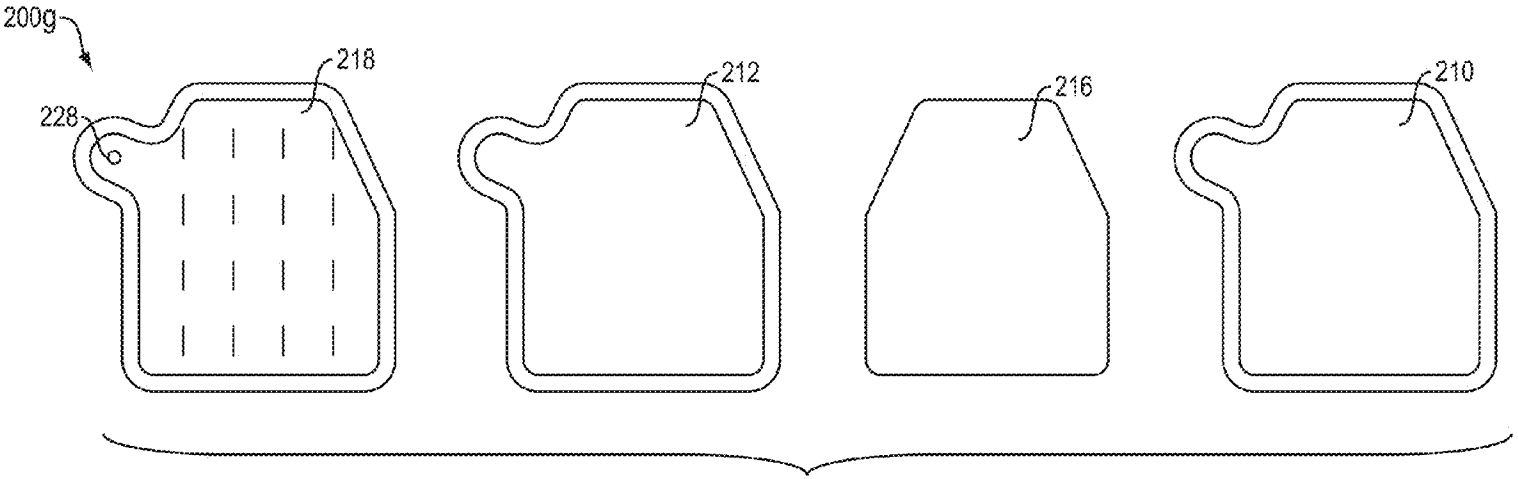
FIG. 11B is an exploded view of the embodiment appearing in FIG. 11A.

FIGS. 11A and 11B illustrate a further exemplary floatation member 200*g*, which is adapted for use with a size small or medium swimmers cut carrier vest. The floatation member 200*g* of FIGS. 11A and 11B is otherwise as described above by way of reference to FIGS. 9A and 9B.

Figure 12A:
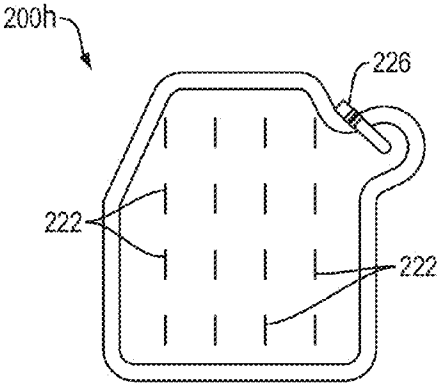
FIG. 12A is a plan view of an exemplary left-sided bladder which is adapted for use in a size small or medium large swimmers cut carrier vest.
Figure 12B:
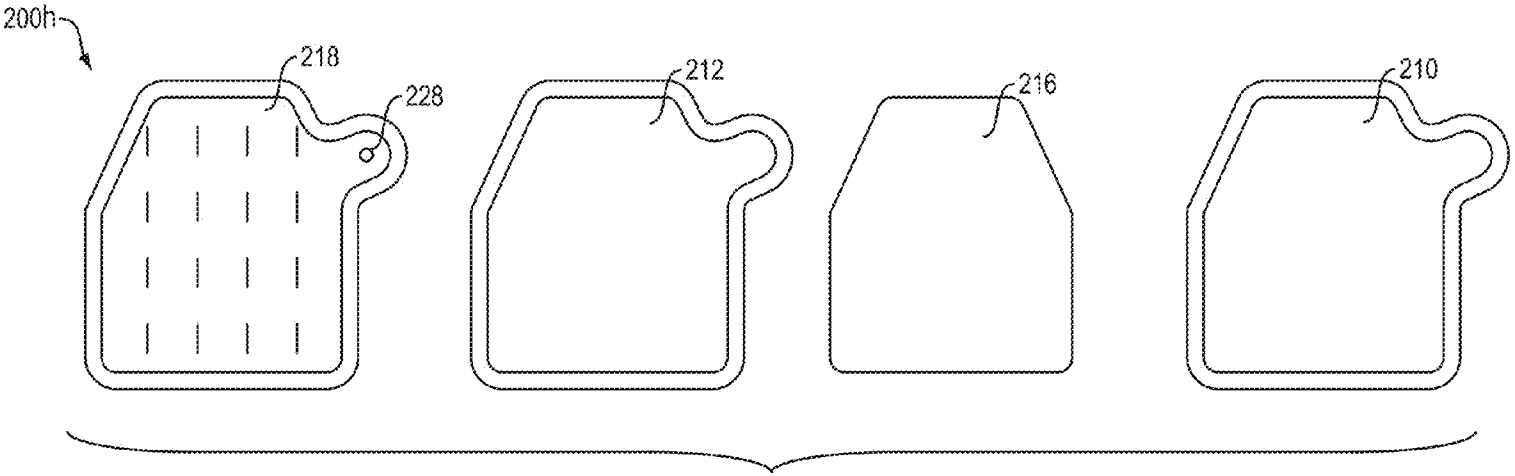
FIG. 12B is an exploded view of the embodiment appearing in FIG. 12A.

Referring now to FIGS. 12A and 12B, there is shown a floatation member 200*h*, which is a mirror image of the floatation member 200*g* appearing in FIGS. 11A and 11B, such that the opening 228 and inflation tube 226 are on the opposite side of the unit. The floatation member 200*h* of FIGS. 12A and 12B is otherwise as described for FIGS. 11A and 11B.

Although the embodiments appearing in FIGS. 5-12 illustrate exemplary embodiments adapted for use in connection with any other carrier vests/ballistic profiles, including Small Arms Protective Insert (SAPI) cut, Enhanced Small Arms Protective Inserts (ESAPI) cut, shooters cut/advanced shooters cut, BALCS/SPEAR cut, and others.

Figure 13:
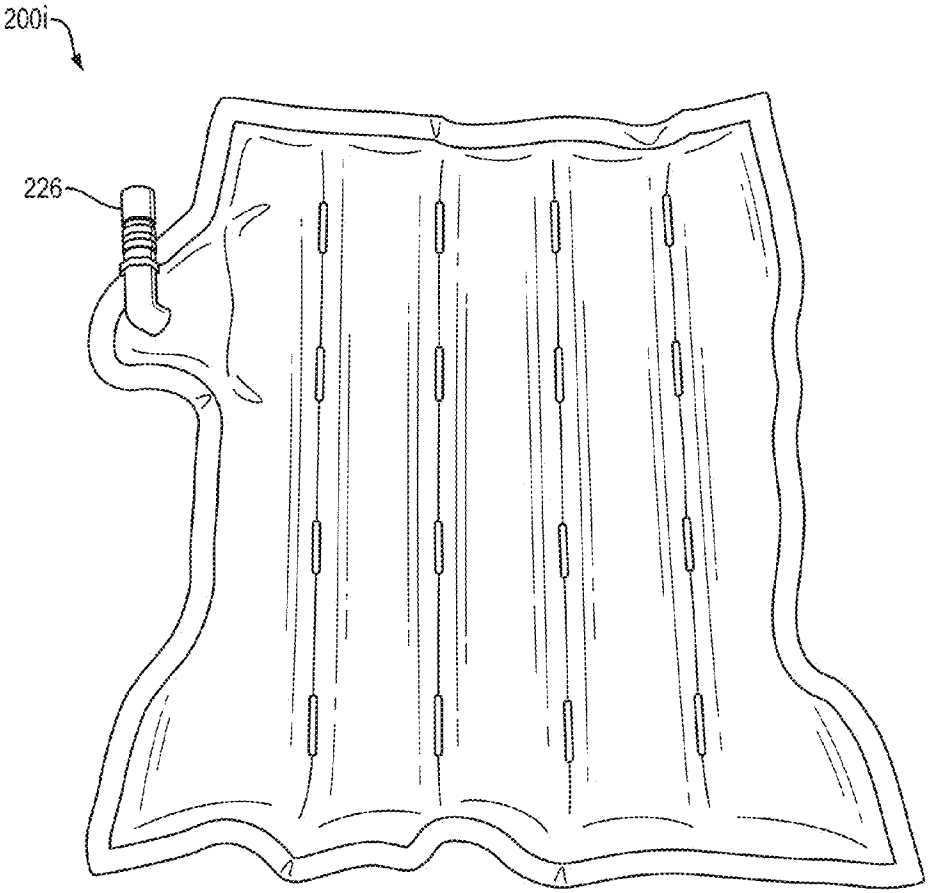
FIG. 13 is an exemplary bladder panel having a shape for use with a Modular Body Armor Vest (MBAV) with an oral inflation valve.

FIG. 13 illustrates a further exemplary floatation panel 200*i*, having a shape for use with a Modular Body Armor Vest (MBAV). The floatation member 200*i* is substantially described above with an oral inflation valve 226.

Figure 14:
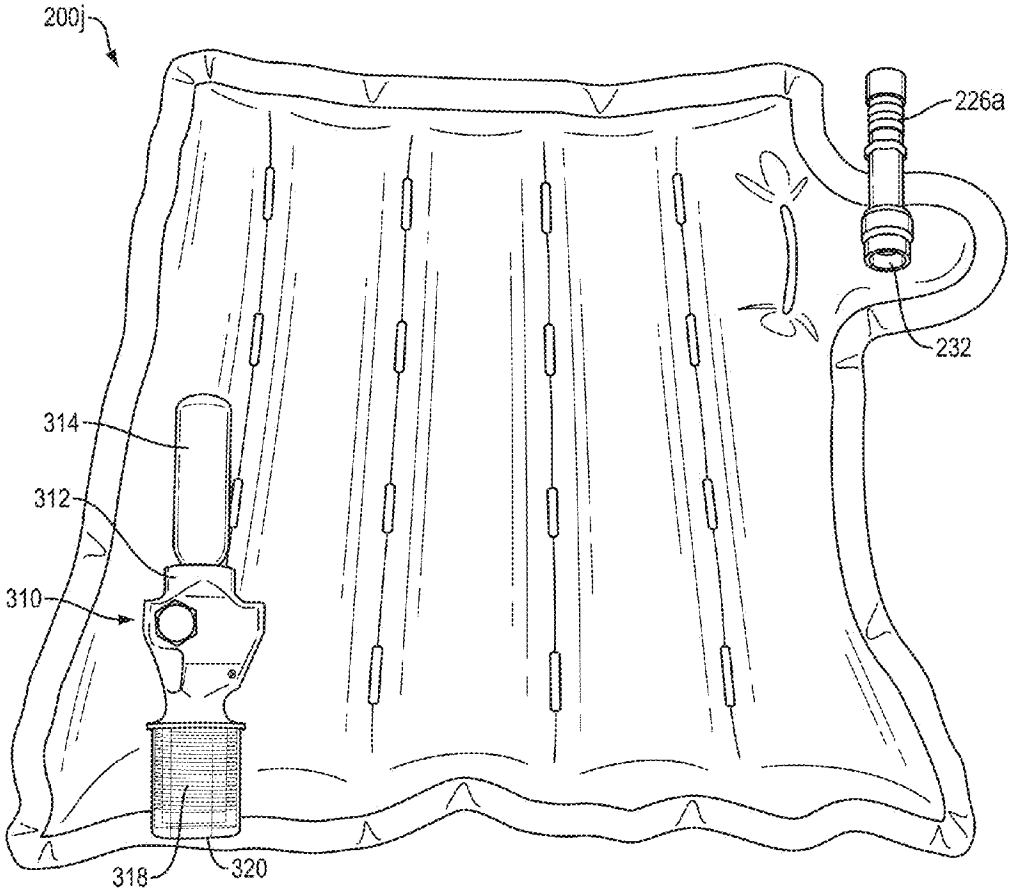
FIG. 14 is an exemplary bladder panel similar to the embodiment appearing in FIG. 13, further including a source of compressed gas for self-inflation of the bladder.

FIG. 14 is an exemplary bladder panel 200*j*, which is similar to the embodiment appearing in FIG. 13, but wherein the oral inflation tube is disposed on the opposite side of the panel, and which further including a source of compressed gas for self-inflation of the bladder. The oral inflation tube 226*a* additionally includes a pressure relief valve 232 on the inflation tube to prevent over-inflation of the bladder.

In the embodiment of FIG. 14, an auto-inflation valve 310 includes an insert 312, such as a threaded insert, for receiving a $CO_2$ cartridge 314. For typical applications, the $CO_2$ canister may range from about 8 to about 12 grams, although other sizes and configurations are contemplated. A manual inflation handle (not shown) may also be mechanically linked to the valve 310. For example, the handle may be attached via a lanyard (not shown) to a lever 316 on the valve. The lever 316 operates a piercing pin which punctures the $CO_2$ cartridge 314 and allows the pressurized $CO_2$ to enter the bladder.

Figure 15:
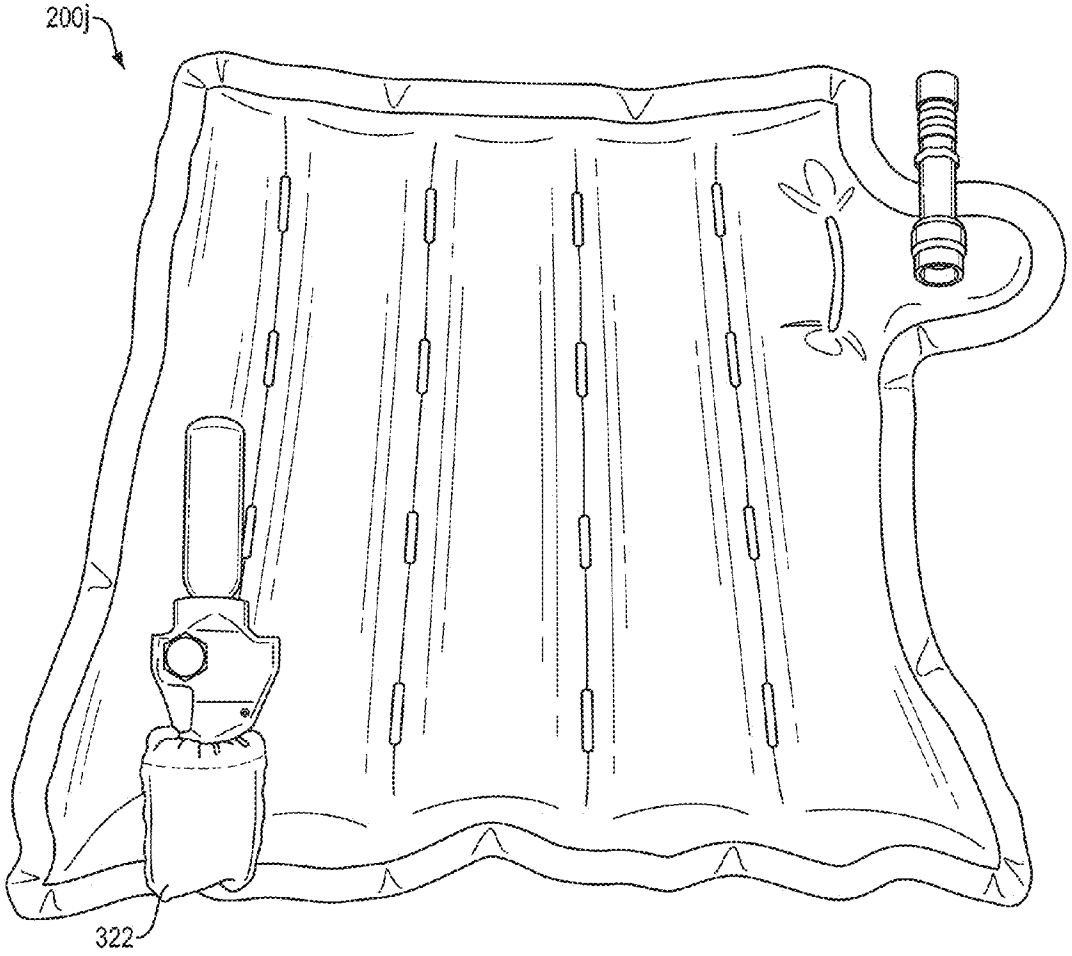
FIG. 15 depicts the embodiment of FIG. 14 which further includes a water resistant cover to slow the entry of water to the auto-inflation actuator.
Figure 16A:
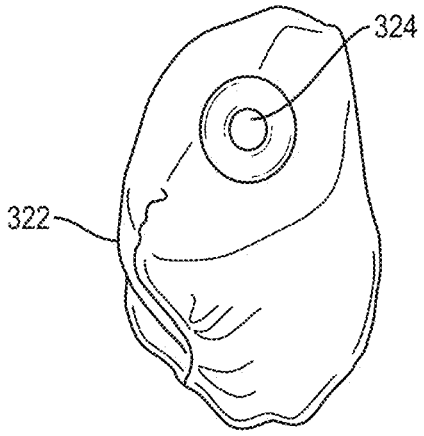
FIGS. 16A and 16B are bottom and side perspective views, respectively, of an exemplary water-resistant cover.
Figure 16B:
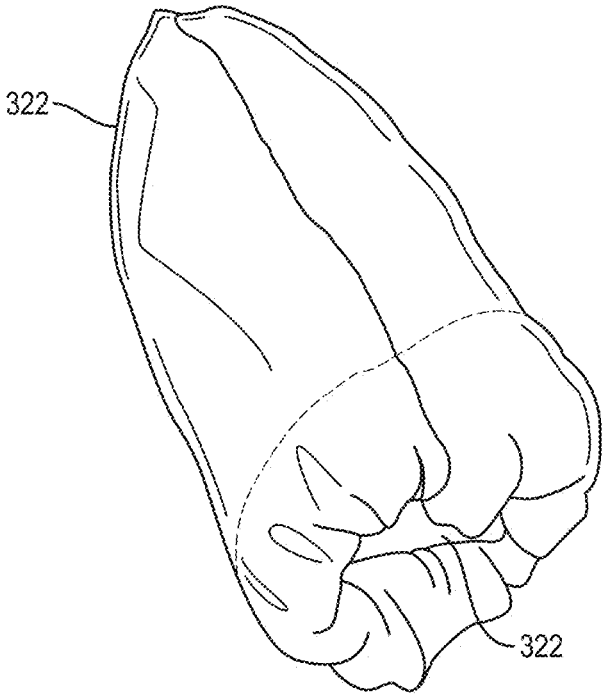

In the illustrated embodiment of FIG. 14, the automatic inflation valve 310 is of the type which uses a captured, compressed spring 318 within a cover 320 which is separated from a piercing pin by a water soluble bobbin or pill, which drives a piercing member to pierce the cartridge and to allow the pressurized gas to enter the bladder chamber. In an especially preferred embodiment, shown in FIG. 15, a water resistant cover 322 may be provided over the valve 310 so as to slow or delay the entry of water. In this manner, inadvertent inflation of bladder due to environmental moisture such as rain, humidity, water spray can be reduced. As best seen in FIGS. 16A and 16B, the cover includes a first opening 324 for receiving the cap portion of the valve 310 containing the spring and bobbin and a small opening 326 providing a somewhat restricted passageway for the entry of water to the auto-actuator. The auto-actuator may be of the type commercially available from Halkey-Roberts Corporation and others, and may advantageously be a Halkey-Roberts ALPHA INFLATOR®. In alternative embodiments, the auto-inflation valve may be on an electronic type which opens the valve when it electrically senses the presence water, for example by sensing a short circuit condition between normally open circuit conductors on the valve when water is present.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined by the appended claims. Accordingly, the scope of the invention should be determined solely by the appended claims and their legal equivalents

What is claimed is:

1. A ballistic safety article for providing ballistic protection for a person, the ballistic safety article comprising:

a carrier adapted to be worn by the person; and at least one flotation member supported by the carrier and disposed inside the carrier and configured to provide neutral and/or positive buoyancy to a user wearing the carrier, wherein the at least one floatation member includes:

a first outer layer;

an intermediate layer overlying the first outer layer, a peripheral edge of the intermediate layer secured to a peripheral edge of the first outer layer to define a first cavity therebetween;

a panel selected from a non-ballistic panel and a ballistic panel received within the first cavity;

a second outer layer overlying the intermediate layer, a peripheral edge of the second outer layer secured to the peripheral edge of the intermediate layer to define a second cavity therebetween; and a valve configured to deliver an inflation gas into the second cavity.

2. The ballistic safety article of claim 1, wherein the at least one removable flotation member is configured to be removably inserted into a pocket in the ballistic carrier vest.

3. The ballistic safety article of claim 1, wherein the panel is a ballistic panel selected from a soft body armor panel and a hard ballistic plate.

4. The ballistic safety article of claim 1, wherein the panel is selected from a closed cell foam panel and an impact resistant panel.

5. The ballistic safety article of claim 1, wherein the panel includes at least one foam panel and at least one panel having anti-ballistic properties.

6. The ballistic safety article of claim 1, wherein the panel is configured to provide neutral buoyancy to a user when worn by the user and wherein the second cavity is configured to provide positive buoyancy to the user when worn by the user and when the second cavity is inflated.

7. The ballistic safety article of claim 1, wherein the peripheral edges of the first outer layer, the intermediate layer, and the second outer layer are RF bonded.

8. The ballistic safety article of claim 1, further comprising one or more pleats formed in the second outer layer.

9. The ballistic safety article of claim 8, wherein the pleats are defined by one or more bonded seams securing the second outer layers to the intermediate layer.

10. The ballistic safety article of claim 9, wherein the one or more bonded seams are configured to break upon application of a preselected threshold pressure in the second cavity.

11. The ballistic safety article of claim 1, the at least one inflation member including an oral inflation tube configured to allow inflation of the second cavity using human breath.

12. The ballistic safety article of claim 1, the at least one inflation member including a source of compressed inflation gas coupled to the valve.

13. The ballistic safety article of claim 12, wherein the source of compressed inflation gas is a cylinder containing compressed carbon dioxide.

14. The ballistic safety article of claim 13, wherein the cylinder containing compressed carbon dioxide is manually activated.

15. The ballistic safety article of claim 13, wherein the cylinder containing compressed carbon dioxide is configured to automatically activate in the presence of water.

16. The ballistic safety article of claim 15, wherein the valve includes a water sensitive member configured to activate the cylinder and the floatation member further including a water-resistant cover disposed over the water-sensitive element configured to slow the entry of water to the water sensitive member.

17. The ballistic safety article of claim 15, further comprising an electronic water sensor configured to automatically activate the cylinder containing compressed carbon dioxide when the presence of water is sensed by the electronic water sensor.

18. The ballistic safety article of claim 1, wherein the at least one inflation member further comprises a pressure relief valve for releasing gas from the second cavity when a gas pressure within the second cavity exceeds a preselected threshold value.

19. The ballistic safety article of claim 1, wherein the at least one inflation member further comprises a water-tight skin surrounding the panel.

* * * * *